US011267120B2

(12) United States Patent
Garcia

(10) Patent No.: US 11,267,120 B2
(45) Date of Patent: Mar. 8, 2022

(54) ELLIPTICAL ARCH SCRIBBING TOOL AND METHOD

(71) Applicant: Adrian Garcia, San Jose, CA (US)

(72) Inventor: Adrian Garcia, San Jose, CA (US)

( * ) Notice: Subject to any disclaimer, the term of this patent is extended or adjusted under 35 U.S.C. 154(b) by 65 days.

(21) Appl. No.: 16/801,410

(22) Filed: Feb. 26, 2020

(65) Prior Publication Data

US 2021/0260748 A1 Aug. 26, 2021

(51) Int. Cl.
*B43L 7/10* (2006.01)
*B25H 7/04* (2006.01)

(52) U.S. Cl.
CPC ..... *B25H 7/045* (2013.01)

(58) Field of Classification Search
CPC ..... B43L 7/10
USPC ..... 33/452, 454, 455, 465
See application file for complete search history.

(56) References Cited

U.S. PATENT DOCUMENTS 1,916,638 A * 7/1933 Rizianu ..... B43L 7/12 33/418
4,048,725 A * 9/1977 Koenuma ..... B43L 13/045 33/447
5,020,233 A * 6/1991 Syken ..... B43L 7/12 33/418
5,208,992 A * 5/1993 Syken ..... B43L 7/12 33/418
5,915,807 A * 6/1999 Ilagan ..... B43L 13/08 33/471
6,134,796 A * 10/2000 Johnson ..... B43L 7/10 33/1 SD
6,141,882 A * 11/2000 Syken ..... B43L 7/12 33/455
6,260,283 B1 * 7/2001 Abernathy ..... B43L 7/12 33/419
7,082,692 B2 * 8/2006 Shapiro ..... B43L 7/10 33/464
7,269,909 B1 * 9/2007 Barbieri ..... B43L 7/12 33/419
8,122,609 B2 * 2/2012 Farr ..... E04F 21/26 33/421
9,731,545 B2 * 8/2017 Flippo ..... B43L 7/10
2002/0148127 A1 * 10/2002 Dana ..... B25H 7/00 33/456
2010/0043243 A1 * 2/2010 Li ..... B43L 7/10 33/471
2012/0285028 A1 * 11/2012 Atwood ..... E04F 21/26 33/452

(Continued)

*Primary Examiner* — George B Bennett
(74) *Attorney, Agent, or Firm* — Lyman Moulton, Esq.; Moulton Patents, PLLC

(57) ABSTRACT

A method includes fixing an axis between a first arm with a lengthwise slide for a first vertex pivot and a second arm comprising an angle indicia proximal a first end and also a lengthwise slide for a second vertex pivot. The axis is configured to interlock the two arms proximal respective first ends in a fixed angular relation based on the angle indicia. A first half of an elliptical arch is scribbed on an elliptical template blank via a scribbing point proximal the axis by sliding the first arm along the lengthwise slide on the first vertex pivot and sliding the second arm along the lengthwise slide on a co-vertex pivot. A second half of the elliptical arch is scribbed by sliding the first arm along the lengthwise slide on the co-vertex pivot and sliding the second arm along the lengthwise slide on the second vertex pivot.

20 Claims, 6 Drawing Sheets

(56) References Cited

U.S. PATENT DOCUMENTS

2015/0168122 A1* 6/2015 Cruickshanks ..... B25H 7/04
33/425

* cited by examiner

ELLIPTICAL ARCH SCRIBBING TOOL AND METHOD

BACKGROUND OF THE INVENTION

The first example of an early Gothic arch in Europe is in Sicily in the Greek fortifications of Gela. The semicircular arch was followed in Europe by the pointed Gothic arch or ogive, whose centreline more closely follows the forces of compression and which is therefore stronger. The semicircular arch can be flattened to make an elliptical arch, as in the Ponte Santa Trinita. Parabolic arches were introduced in construction by the Spanish architect Antoni Gaudi, who admired the structural system of the Gothic style, but for the buttresses, which he termed "architectural crutches". The first examples of the pointed arch in the European architecture are in Sicily and date back to the Arab-Norman period.

Conventional tools available for constructing elliptical arches are cumbersome and impractical. There is a need in the market for an elliptical arch master which is easy to use and accurate.

SUMMARY OF THE INVENTION

A disclosed elliptical arch scribbing system includes a first flatstock arm comprising a lengthwise slide for a first vertex pivot and comprising a first end. The system also includes a second flatstock arm comprising an angle indicia proximal a first end and comprising a lengthwise slide for a second vertex pivot. The system additionally includes an axis configured to interlock the two flatstock arms proximal respective first ends in a fixed angular relation based on the angle indicia. The system further includes an elliptical arch template blank comprising a first and a second vertex pivots and a co-vertex pivot fixed on the elliptical arch template blank.

A disclosed method includes fixing an axis between a first flatstock arm comprising a lengthwise slide for a first vertex pivot and comprising a first end and a second flatstock arm comprising an angle indicia proximal a first end and comprising a lengthwise slide for a second vertex pivot, the axis configured to interlock the two flatstock arms proximal respective first ends in a fixed angular relation based on the angle indicia. The method also includes scribbing a first half of an elliptical arch on an elliptical template blank via a scribbing point proximal the axis by sliding the first flatstock arm along the lengthwise slide on the first vertex pivot and sliding the second flatstock arm along the lengthwise slide on a co-vertex pivot. The method additionally includes scribbing a second half of the elliptical arch on the elliptical template blank via the scribbing point proximal the axis by sliding the first flatstock arm along the lengthwise slide on the co-vertex pivot and sliding the second flatstock arm along the lengthwise slide on the second vertex pivot.

Other aspects and advantages of embodiments of the disclosure will become apparent from the following detailed description, taken in conjunction with the accompanying drawings, illustrated by way of example of the principles of the disclosure herein.

Figure 1:
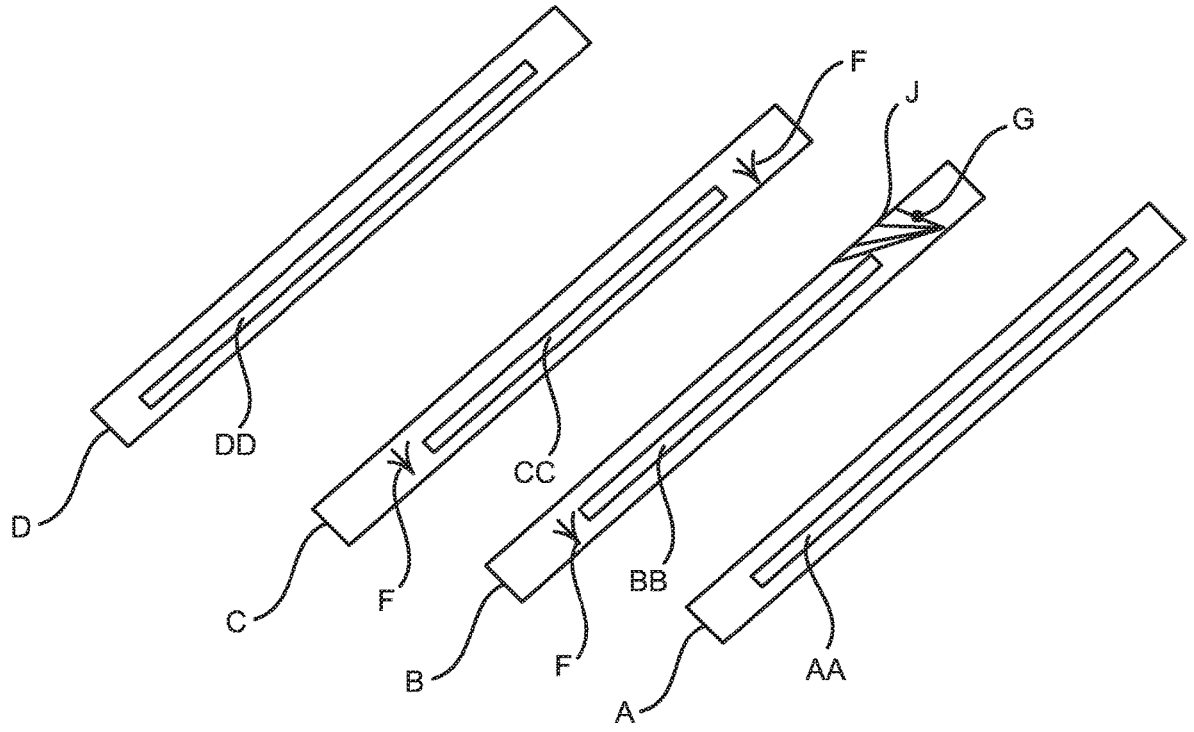
FIG. 1 is a depiction of the component members of the elliptical arch scribbing tool in accordance with an embodiment of the present disclosure.

Throughout the description, similar and same reference numbers may be used to identify similar and same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to a person of ordinary skill in the relevant art and having possession of this disclosure, are to be considered within the scope of the invention.

Throughout the present disclosure, the term "slide" refers to the ability of a component of the disclosure to move past or move around a pivot. Also throughout the present disclosure, the term "vertex" is a conventional geometrical point on an ellipse at the elongated curves thereof near the focii. The co-vertex is that point on the top of the ellipse in the middle or equidistant to both the first and the second vertex.

The Elliptic Arch Master consists of the following two (2) items: 1) Tracing Arms and 2) Connecting Bolts. The main purpose of the Elliptic Arch Master is to simplify the process of constructing elliptic arches by providing carpenters with a tool for quickly and accurately drawing the outline of any desired elliptic arch onto the working material. Elliptical arches are commonly used in many architectural situations, such as doorways or area dividers, and the sides of these arches are typically cut straight from a sheet of plywood.

The problem every carpenter faces is that of trying to accurately draw the outline of the intended arch onto the plywood. There is no existing tool designed specifically for this job, so the carpenter is forced to improvise. The various methods carpenters have developed over the years for this purpose all tend to be complicated and time-consuming, and the carpenter is often frustrated by less than perfect results. Ingenious and practical, the Elliptic Arch Master overcomes these problems by providing carpenters with a tool that can quickly draw any size of elliptic arch with total precision.

The Elliptic Arch Master consists of two arms that are bolted together at one end. Each arm has a primary section and an extending section, so that the size of the Arch Master can be adjusted as needed. The two sections of each arm are connected together by a tongue and groove system. Where the surfaces of the two sections come together, one surface will have two grooves cut along the length of the section and the other surface will have two protruding tongues along the length of the section that exactly match the shape and size of the two grooves. In this way the two sections of each arm are kept perfectly aligned at all times.

The two sections of each arm are also connected by a screw bolt, and the heads of these connecting bolts are countersunk so that they are flush with the surface of their respective sections. These connecting bolts are secured with butterfly nuts to facilitate quick and easy loosening and re-tightening. In order that these bolts can move freely when the length of the arms is being adjusted, each of the extending sections has a slot cut along its center line, stopping just short of the ends. The width of this slot matches the width of the connecting screw bolt. Where the two arms of the Arch master are bolted together the connecting surface of each arm must be roughened. This will create friction between the two surfaces. This is done so that after the two arms are screwed together, no movement between the arms will be possible and the angle between the arms cannot accidentally change.

When an elliptic arch is to be drawn, the carpenter will first mark the width of the base of the arch on the plywood by drawing a straight line of the required length. At each end of that line he will hammer a wire nail into the plywood, leaving two inches of each nail projecting upwards. At the midway point in that base line the carpenter will then draw another line perpendicular to the base. The length of the perpendicular line will exactly equal the vertical height of the arch apex from the arch base. At that apex point the carpenter will drive in a third nail.

The carpenter will now draw a line from the apex nail to one of the base nails and measure the angle between that new line and the base line. This angle will now be transferred to the Elliptic Arch Master. On the surface of one of the tracing arms a series of gradient lines are marked, all originating from a point on the edge of the tracing arm adjacent to the connecting bolt. To transfer the angle, the butterfly nut is loosened and the upper tracing arm is rotated until the end of the upper arm lines up exactly with the appropriate gradient line on the lower tracing arm. The butterfly nut is retightened and the Arch Master is ready to use.

FIG. 1 is a depiction of the component members of the elliptical arch scribbing tool in accordance with an embodiment of the present disclosure. The depiction includes a first flatstock arm C, a second flatstock arm B, a first extension arm D for the first flatstock C, a second extension A for the second flatstock arm B, the wingnut and bolt combination F and the axis G defined in the second flatstock arm B adjacent the angle indicia J, the lengthwise slides or slots AA, BB, CC and DD in the respective flatstock arms A, B, C and D.

Figure 2:
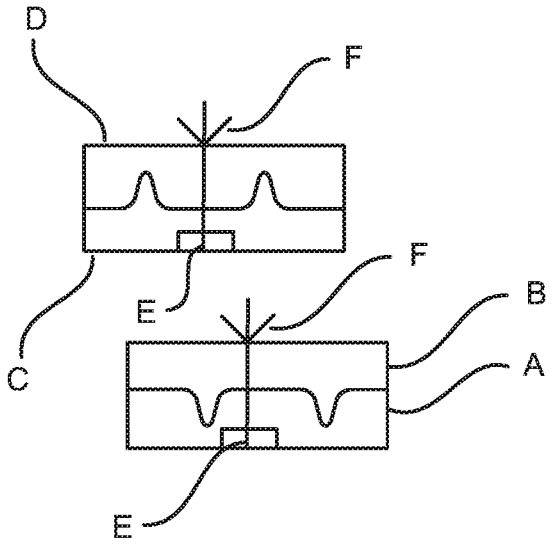
FIG. 2 is a depiction of the tongue and groove relation of component members thereof in accordance with an embodiment of the present disclosure.

FIG. 2 is a depiction of the tongue and groove relation of component members thereof in accordance with an embodiment of the present disclosure. The depiction includes tongue and groove relations between A and B held in compression by a wingnut F and bolt E. Likewise is depicted the tongue and groove relations C and D held in compression by wingnut F and bolt E. The views are end views similar to cross sectional views. The tongue and groove run lengthwise. The tongue and groove keep the extension flatstock arms parallel to the respective flatstock arms.

Figure 3:
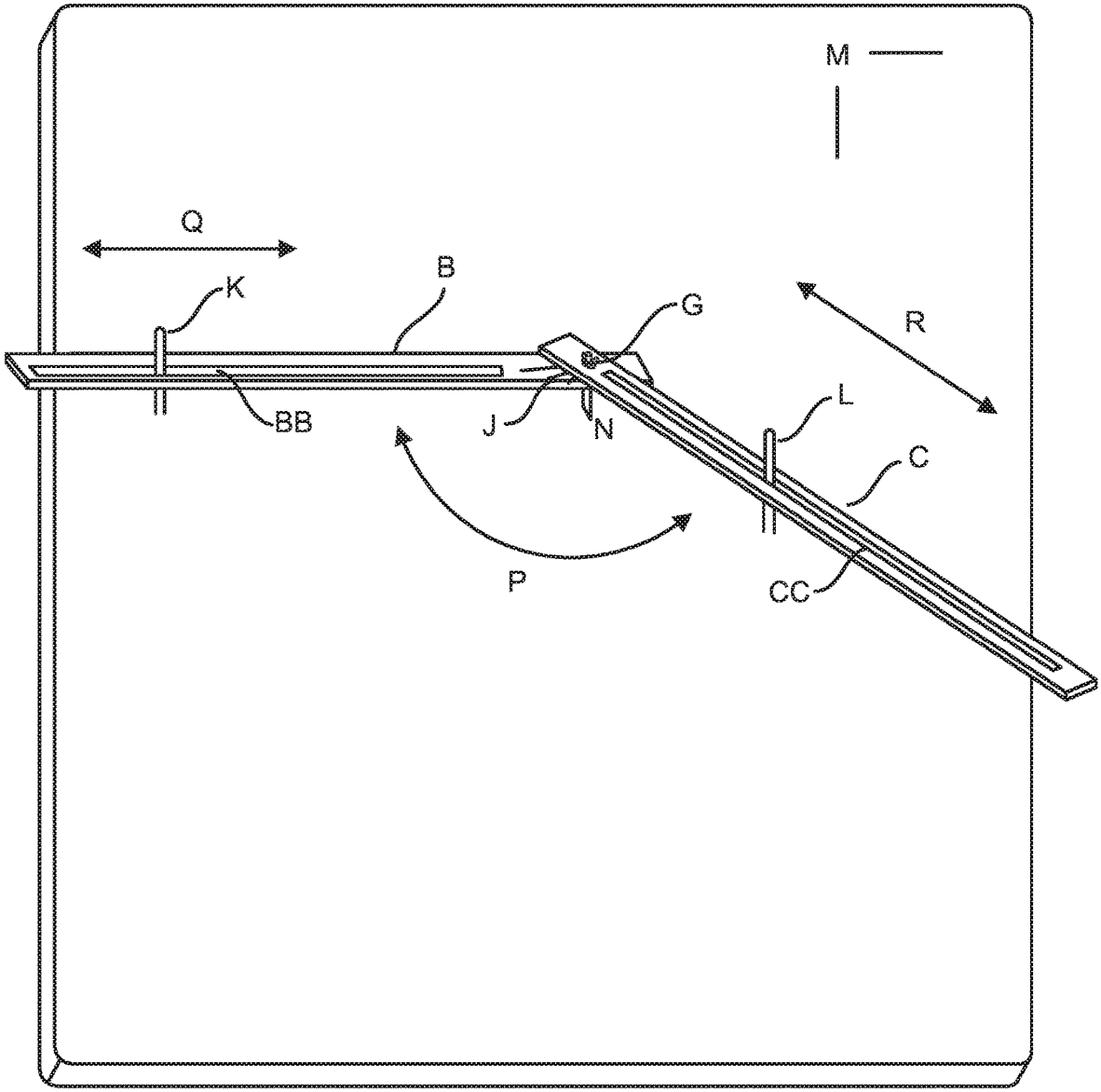
FIG. 3 is a depiction of the interlocking elliptical arms in accordance with an embodiment of the present disclosure.

FIG. 3 is a depiction of the interlocking elliptical arms in accordance with an embodiment of the present disclosure. The depiction includes the first flatstock arm C and the second flatstock arm B interlocked in an angular relation set by the angle indicia J. The slides or slots BB and CC allow the respective flatstock arm to slide on a first vertex pivot K and on a co-vertex pivot L on an elliptical arch template blank M such as a sheet of plywood. The scribbing point N is located proximal the axis G and scribs the ellipsis as the flatstock arms slide along the pivots. The action arrow P indicates the angular relation between the flatstock arms is variable and fixed with the wingnut and bolt at the axis G. The action arrow Q indicates the sliding action of the second flatstock arm on the vertex pivot K. The action arrow R indicates the sliding action of the first flatstock arm on the co-pivot L fixed on the plywood blank.

Figure 4:
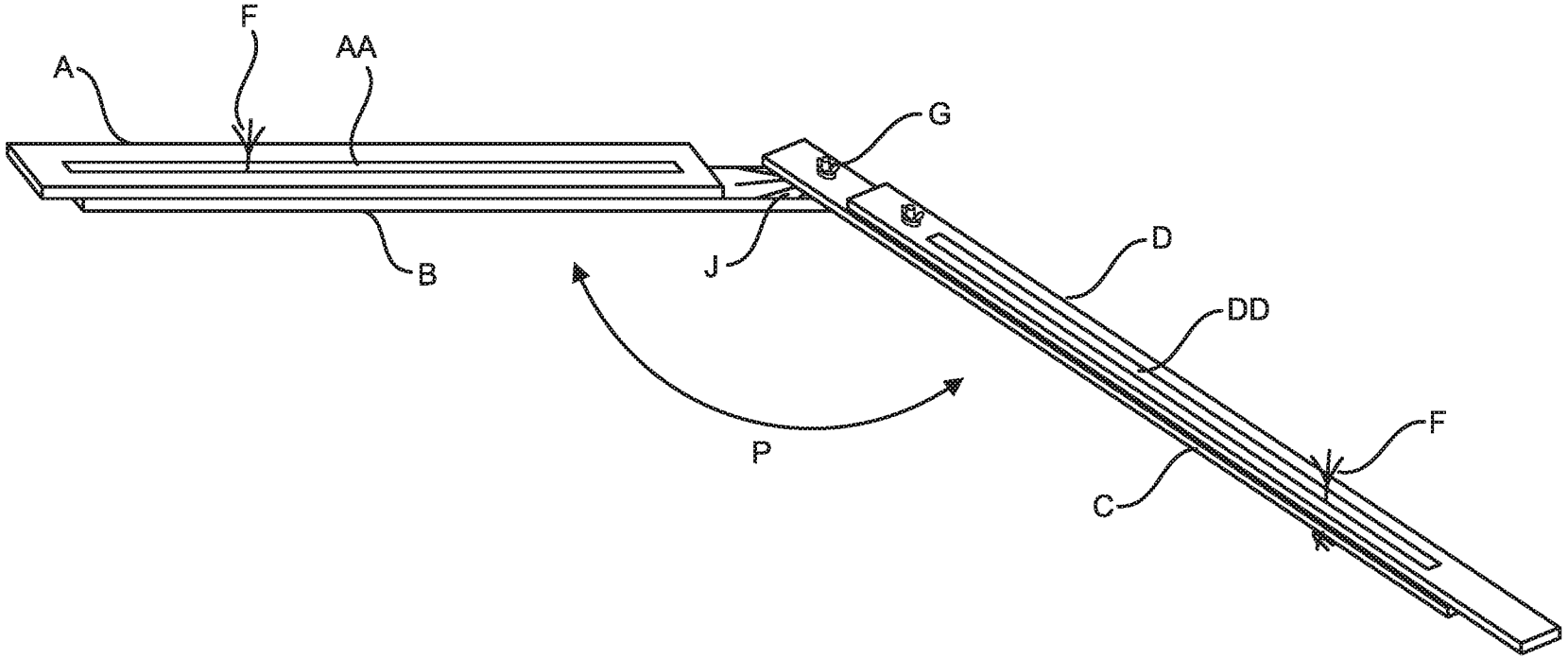
FIG. 4 is a depiction of two interlocking elliptical arms set to an angle indicia in accordance with an embodiment of the present disclosure.

FIG. 4 is a depiction of two interlocking elliptical arms set to an angle indicia in accordance with an embodiment of the present disclosure. The depiction includes elements and reference characters similar and same to those depicted in prior figures but also includes the extension arms A and D. The slides or slots AA and DD allow the extension arms to be adjusted in a compression fit by the wingnut F and bolts E.

Figure 5:
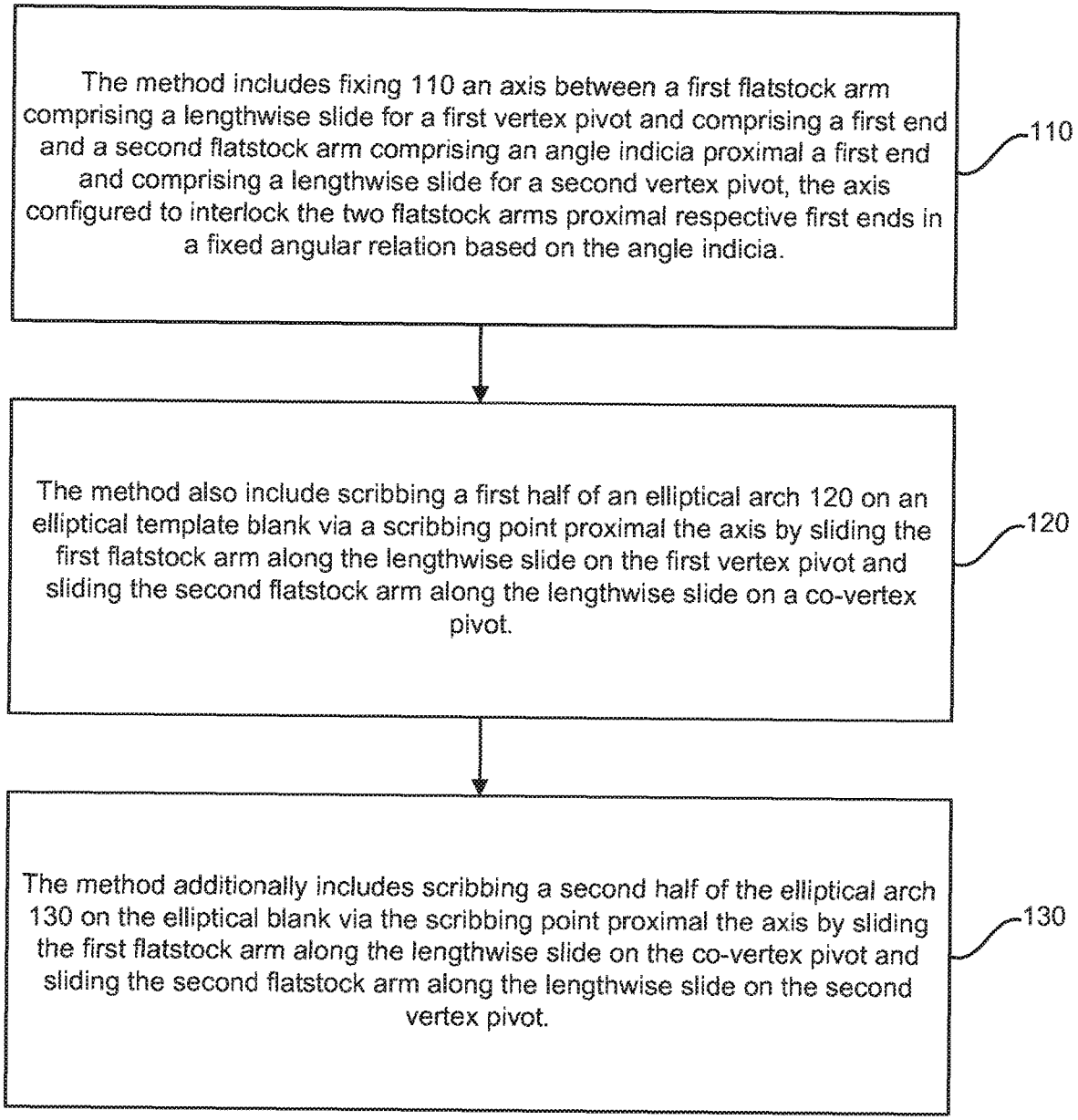
FIG. 5 is a block diagram of a method of scribbing an elliptical arch via interlocking elliptical arms in accordance with an embodiment of the present disclosure.

FIG. 5 is a block diagram of a method of scribbing an elliptical arch via interlocking elliptical arms in accordance with an embodiment of the present disclosure. The method includes fixing 110 an axis between a first flatstock arm comprising a lengthwise slide for a first vertex pivot and comprising a first end and a second flatstock arm comprising an angle indicia proximal a first end and comprising a lengthwise slide for a second vertex pivot, the axis configured to interlock the two flatstock arms proximal respective first ends in a fixed angular relation based on the angle indicia. The method also includes scribbing a first half of an elliptical arch 120 on an elliptical template blank via a scribbing point proximal the axis by sliding the first flatstock arm along the lengthwise slide on the first vertex pivot and sliding the second flatstock arm along the lengthwise slide on a co-vertex pivot. The method additionally includes scribbing a second half of the elliptical arch 130 on the elliptical template blank via the scribbing point proximal the axis by sliding the first flatstock arm along the lengthwise slide on the co-vertex pivot and sliding the second flatstock arm along the lengthwise slide on the second vertex pivot.

Figure 6:
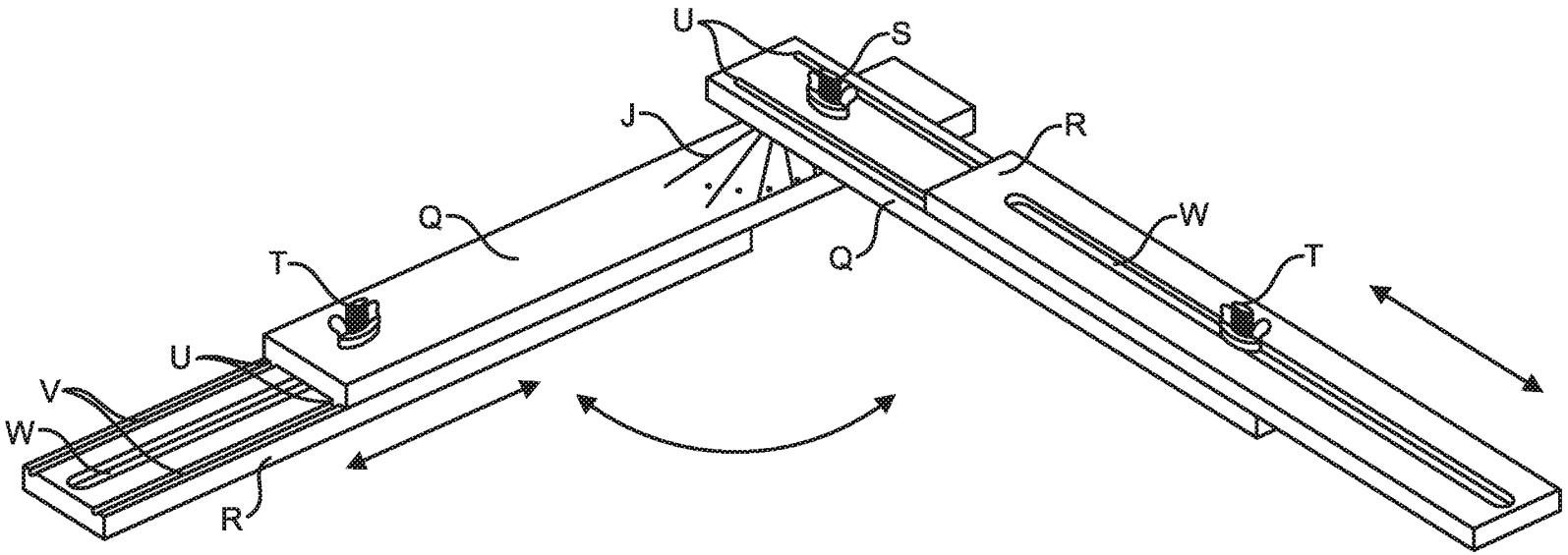
FIG. 6 is a depiction of two tongue and groove interlocking elliptical arms set to an angle indicia in accordance with an embodiment of the present disclosure.

FIG. 6 is a depiction of two tongue and groove interlocking elliptical arms set to an angle indicia in accordance with an embodiment of the present disclosure. The depiction includes elements and reference characters similar and same to those depicted in prior figures but also includes the arms Q and the extension arms R. The slides or slots W allow the extension arms to be adjusted in a compression fit by the wingnuts T. Tongue U and groove V allow the extension arms to slide parallel to the arms Q and R.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents included herein or by reference to a related application.

What is claimed is:

1. An elliptical arch scribbing tool, comprising:

a first flatstock arm comprising a lengthwise slide for a first vertex pivot and comprising a first end;

a second flatstock arm comprising an angle indicia proximal a first end and comprising a lengthwise slide for a second vertex pivot;

an axis configured to interlock the two flatstock arms proximal respective first ends in a fixed angular relation based on the angle indicia; and a scribbing point proximal the axis.

2. The tool of claim 1, wherein the lengthwise slide of each flatstock arm is a lengthwise slot configured to receive a fixed vertex pivot on a arch template blank.

3. The tool of claim 1, wherein the scribbing point holds a marker configured to scrib an elliptical arch onto an arch template blank.

4. The tool of claim 1, wherein the axis comprises a bolt and a wingnut, the bolt inserted through a hole defined in the first ends of the flatstock arms.

5. The tool of claim 1, wherein the angle indicia comprises raised lines emanating from the axis at 15 degree increments toward a second end of the second flatstock arm.

6. The tool of claim 1, wherein the first and the second flatstock arms comprise any rigid material including aluminum, steel, wood, plastic and composites thereof.

7. The tool of claim 1, further comprising an extension arm for the first flatstock arm and an extension arm for the second flatstock arm, the extension arms held in a lengthwise tongue and groove parallel relation via a bolt and a wingnut compression.

8. The tool of claim 7, wherein the lengthwise tongue and groove parallel relation comprises a lengthwise dual track on either side of the bolt and the wingnut compression.

9. The tool of claim 1, wherein the lengthwise slides comprise an inside lengthwise side of the flatstock arms.

10. The tool of claim 1, wherein the scribbing point comprises an inside vertex formed by the fixed angular relation of the flatstock arms.

11. The tool of claim 1, wherein the angle indicia further comprises a radial crenellation on the first flatstock arm and a complementary crenellation on the second flatstock arm configured to interlock the members in an angular relation.

12. An elliptical arch scribbing system, comprising:

a first flatstock arm comprising a lengthwise slide for a first vertex pivot and comprising a first end;

a second flatstock arm comprising an angle indicia proximal a first end and comprising a lengthwise slide for a second vertex pivot;

an axis configured to interlock the two flatstock arms proximal respective first ends in a fixed angular relation based on the angle indicia; and an elliptical arch template blank comprising a first and a second vertex pivots and a co-vertex pivot fixed on the elliptical arch template blank.

13. The system of claim 12, wherein the first and the second vertex pivots are fixed opposing each other at a respective first bottom point and a second bottom point of the elliptical arch and the co-vertex pivot is fixed at a top of the elliptical arch.

14. The system of claim 12, wherein the elliptical arch template blank is a sheet of plywood and the first and the second vertex pivots and the co-vertex pivot are nails driven into the sheet of plywood.

15. A method for scribbing an elliptical arch, the method comprising:

fixing an axis between a first flatstock arm comprising a lengthwise slide for a first vertex pivot and comprising a first end and a second flatstock arm comprising an angle indicia proximal a first end and comprising a lengthwise slide for a second vertex pivot, the axis configured to interlock the two flatstock arms proximal respective first ends in a fixed angular relation based on the angle indicia;

scribbing a first half of an elliptical arch on an elliptical template blank via a scribbing point proximal the axis by sliding the first flatstock arm along the lengthwise slide on the first vertex pivot and sliding the second flatstock arm along the lengthwise slide on a co-vertex pivot; and scribbing a second half of the elliptical arch on the elliptical template blank via the scribbing point proximal the axis by sliding the first flatstock arm along the lengthwise slide on the co-vertex pivot and sliding the second flatstock arm along the lengthwise slide on the second vertex pivot.

16. The method of claim 15, further comprising fixing the first and the second vertex pivots opposing each other at a respective first bottom point and a second bottom point of the elliptical arch and fixing the co-vertex pivot at a top of the elliptical arch.

17. The method of claim 15, further comprising bolting an extension arm to the first flatstock arm and bolting an extension arm to the second flatstock arm, the extension arms held in a lengthwise tongue and groove parallel relation via a bolt and a wingnut compression.

18. The method of claim 15, further comprising determining the fixed angular relation equal to a measuring an the angle from the first vertex to the co-vertex relative to a line connecting the first vertex to the second vertex.

19. The method of claim 15, further comprising scribbing the second half of the elliptical arch on the elliptical template blank via the scribbing point proximal the axis by sliding the first flatstock arm along the lengthwise slide on the second vertex pivot and sliding the second flatstock arm along the lengthwise slide on the co-vertex pivot.

20. The method of claim 19, further comprising scribbing the first half of the elliptical arch on the elliptical template blank via the scribbing point proximal the axis by sliding the first flatstock arm along the lengthwise slide on the co-vertex pivot and sliding the second flatstock arm along the lengthwise slide on the first vertex pivot.

* * * * *